US008286669B2

(12) United States Patent
Yoneda

(10) Patent No.: US 8,286,669 B2
(45) Date of Patent: Oct. 16, 2012

(54) METHOD OF MANUFACTURING LIQUID STORAGE CONTAINER

(75) Inventor: Isamu Yoneda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 677 days.

(21) Appl. No.: 12/497,346

(22) Filed: Jul. 2, 2009

(65) Prior Publication Data

US 2010/0011577 A1 Jan. 21, 2010

(30) Foreign Application Priority Data

Jul. 17, 2008 (JP) ..... 2008-186115

(51) Int. Cl.
*B65B 1/04* (2006.01)

(52) U.S. Cl. ..... 141/2; 141/329; 53/452; 53/467; 347/86

(58) Field of Classification Search ..... 141/2, 329; 401/141, 142; 29/505; 53/452, 467; 347/85–87
See application file for complete search history.

(56) References Cited

U.S. PATENT DOCUMENTS 2,957,453 A * 10/1960 Eckerle ..... 401/209
3,187,724 A * 6/1965 Zepell ..... 401/235
3,352,622 A * 11/1967 Schachter ..... 401/141
5,821,965 A * 10/1998 Oda et al. ..... 347/86
6,471,346 B2 * 10/2002 Kishida et al. ..... 347/86
6,490,792 B1 * 12/2002 Ishinaga et al. ..... 29/890.1
6,530,708 B2 * 3/2003 Ichikawa ..... 401/142
6,692,115 B2 * 2/2004 Sanada et al. ..... 347/85
6,728,990 B1 * 5/2004 Jones ..... 15/260
6,854,835 B2 * 2/2005 Kobayashi et al. ..... 347/85
6,899,417 B1 * 5/2005 Shinada et al. ..... 347/86

FOREIGN PATENT DOCUMENTS

JP 2006-159656 6/2006

* cited by examiner

*Primary Examiner* — Timothy L Maust
(74) *Attorney, Agent, or Firm* — Fitzpatrick, Cella, Harper & Scinto

(57) ABSTRACT

An ink absorption member is inserted into a tank case and positioned to define an open space V between its bottom surface and the tank case bottom. Sequentially, then, one ink injection needle is inserted through the ink absorption member in the tank case until the tip enters the open space V. Thereafter, ink injection is begun by supplying ink through the injection needle tip. As this process proceeds, the open space V is filled with ink, the upper surface of which serves as an interface, parallel to the tank case bottom. This parallel state is maintained as the ink permeates the ink absorption member, so that the process can be uniformly completed. Further, since the open space V is filled first, the ink injection speed is not overly slow, when compared with a process during which ink is directly injected into the ink absorption member.

5 Claims, 9 Drawing Sheets

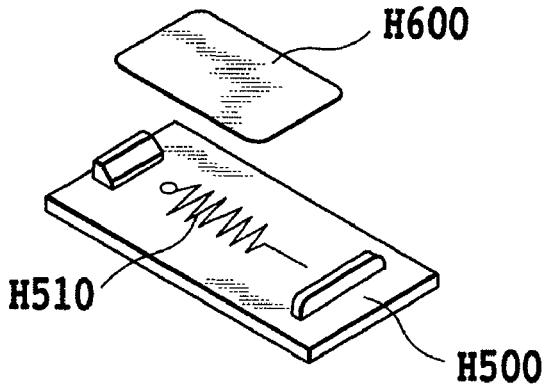
FIG. 6
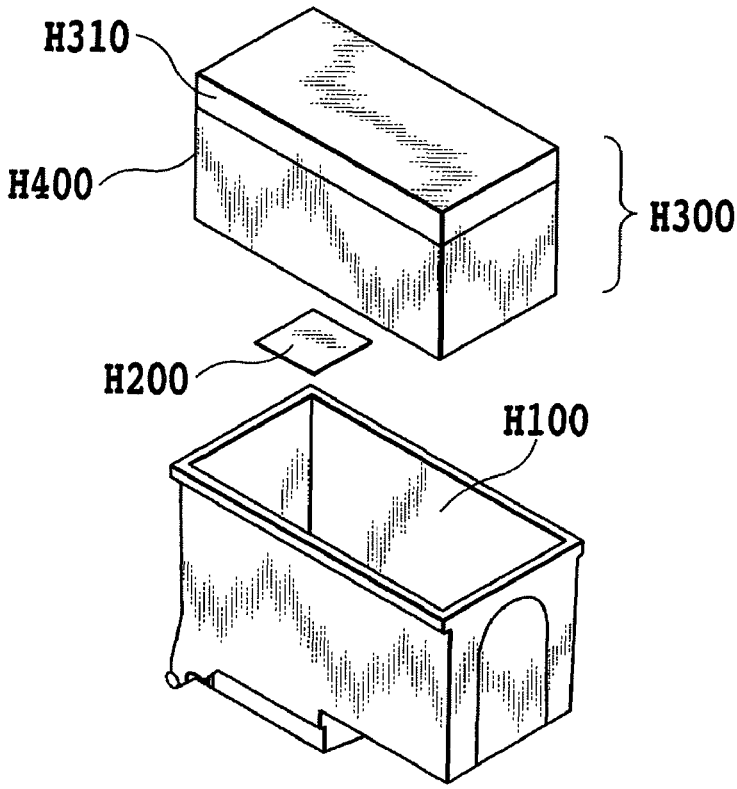

METHOD OF MANUFACTURING LIQUID STORAGE CONTAINER

BACKGROUND OF THE INVENTION

1. Field of the Invention

The present invention relates to a method of manufacturing a liquid storage container, and relates in particular to an arrangement for injecting a liquid into a liquid storage container provided with a liquid absorption member for retaining the liquid such as ink.

2. Description of the Related Art

As this kind of a liquid storage container, an ink tank that is employed for inkjet printing is well known, and one form of ink tank internally includes an ink absorption member for absorbing ink. FIG. 6 is an exploded perspective view showing an example of such a conventional ink tank made by integrating a print head portion and an ink tank portion in which ink to be supplied to the print head is stored.

As shown in FIG. 6, an ink tank H100 includes an ink absorption member H300 that is inserted into the ink tank in a compressed state, and an ink H400 permeates the ink absorption member H300 and is retained by the ink absorption member H300. Here, a balance is adjusted between an ink retention force of the ink absorption member H300 and a meniscus retention force at the ink ejection opening of the print head to be in a certain range, so that a satisfactory ink supply condition can be obtained without a leakage occurring at the ink ejection opening. In this arrangement, a filter H200 is provided between the ink absorption member H300 and the print head portion. A hole and a groove are formed in a cover member H500 of the ink tank, and a sealing member H600, for covering the hole and the groove, is attached to the cover member H500. This allows an air communication port H510 for adjusting fluctuations in the internal pressure of the ink tank H100 to be formed.

In a distribution of ink tanks, there is possibilities that contents of a ink tank freeze when the ink tanks are in cold areas or when the ink tanks are stored in a warehouse wherein air conditioning is not provided. If the freezing of the ink tank occurs, the leakage of ink may occur. FIGS. 7A to 7D are views illustrating this leakage phenomenon. For the ink tank shown in FIG. 6, there may be a case, as shown in FIG. 7A, where ink has unevenly permeated the ink absorption member H300, and an interface I formed with ink is made concavo-convex. In this case, when, for example, ink H400 freezes in a position of the ink tank in which the air communication port H510 faces downward, freezing expands the volume of the ink H400 permeating the ink absorption member H300. As a result, the ink H400 moves into a layer H310, which is the portion of the ink absorption member H300 that the ink H400 has not permeated. Consequently, the volume of the ink un-permeated layer H310 of the ink absorption member H300 is reduced, as shown in FIG. 7B.

If the distribution of the ink permeating the ink absorption member H300 is not uniform and thus the ink un-permeated layer H310 has a comparatively thin portion as shown in FIG. 7C, the thin portion of the ink un-permeated layer H310 disappears by repeating freezing and melting of the ink only a number of times. As a result, further freezing and melting cause the ink to be moved and to ooze from a portion where the ink un-permeated layer H310 has disappeared, and thus ink may leak out through the air communication port H510, as shown in FIG. 7D.

In order to prevent such an ink leakage, an ink un-permeated layer 310 of the ink absorption member H300 can be formed that is comparatively thicker, so that the loss of the layer H310 may be avoided, even when the freezing and melting of ink H400 is repeated several times. That is, it is preferable that a flat, thick, ink un-permeated layer H310 be obtained when ink H400 has been permeated the ink absorption member H300. More specifically, it is preferable that the ink filling process be performed so as to provide an ink un-permeated layer H310 having a uniform thickness in order to obtain a certain thickness of the ink un-permeated layer within a limited size of ink tank.

A conventional example of injecting ink into an ink absorber is disclosed in Japanese Patent Laid-Open No. 2006-159656, in which a plurality of ink injection needles are employed to inject ink into the ink absorption member. According to the filling method described in Japanese Patent Laid-Open No. 2006-159656, a volume of ink to be supplied to an ink absorption member is adjusted for each injection needle to obtain the uniform ink permeated state.

In a method described in Japanese Patent Laid-Open No. 2006-159656, which injects ink into an absorption member using a plurality of ink injection needles 300, balancing the volume of ink supplied by each of the multiple ink injection needles 300 is important. When a good balance is secured for the volumes of ink supplied by the respective ink injection needles 300, the uniform ink permeated state shown in FIG. 8A is attained. However, once the balance for the volumes of ink supplied by the respective ink injection needles 300 is lost, the volume of ink H400 permeating an ink absorption member H300 is changed, and as shown in FIG. 8B, the ink permeated state becomes non-uniform. As a result, the thickness of an ink un-permeated layer H310 is also non-uniform.

To prevent this problem, in the conventional method described in Japanese Patent Laid-Open No. 2006-159656, filling syringes are required for the respective ink injection needles to balance the volumes of ink supplied by the respective ink injection needles 300. However, in this case, an increased number of parts is required for an ink filling device, which thus becomes larger and more complicated.

Furthermore, there is a case wherein, for a compact ink tank, the space originally available is insufficient for employing a plurality of ink injection needles.

On the other hand, an ink supplying arrangement that employs a single ink injection needle 300, may attain a uniform ink permeated state, if ink filling amount per unit time is extremely made small. For example, when a filling period of about one minute is provided for an ink tank having an ink capacity of 24 g, a uniform ink permeated state can be attained. However, in this case, the tact time required by the ink filling device is dramatically extended, and thus, to provide increased production efficiency, additional injection devices are required. This then becomes but one of the reasons why this solution will not provide a production cost reduction.

SUMMARY OF THE INVENTION

The object of the present invention is to provide a method of manufacturing a liquid storage container, for which uniform filling state of liquid can be formed, while avoiding the need to increase the size and to complicate the structure of an ink filling devices and to raise production costs.

In an aspect of the present invention, there is provided a method of manufacturing a liquid storage container that includes a liquid storage portion and an absorption member for retaining liquid and is mounted on a liquid ejection apparatus, the method comprising the steps of: filling the liquid storage portion with the liquid; making a surface of the liquid in the liquid storage portion and the absorption member which is located to be opposed to the surface of the liquid in the liquid storage portion contact with each other; and inserting the absorption member into the liquid storage portion.

According to the above arrangement, after a liquid is supplied to fill a liquid storage portion, a surface of liquid in the liquid storage portion and an absorption member are brought into contact with each other. Thus, the contact of the liquid surface with the absorption member is made in a condition that the interface of liquid which is substantially parallel to a bottom of the liquid storage portion is formed. Then, permeation of ink into the absorption member after the contact of the liquid surface can be also performed while keeping the above parallel condition. Further, since the liquid is injected to fill the liquid storage portion first, the injection speed is not extremely slow, compared with a method of injecting a liquid directly into a liquid absorption member.

As a result, the state wherein the liquid is uniformly filled can be obtained, without increasing the size of the ink filling device and complicating the structure of the device, and raising the production costs.

Further features of the present invention will become apparent from the following description of exemplary embodiments (with reference to the attached drawings).

BRIEF DESCRIPTION OF THE DRAWINGS

FIG. 6 is an exploded perspective view illustrating an example arrangement of an ink tank;

DESCRIPTION OF THE EMBODIMENTS

The embodiments of the present invention will now be described in detail while referring to accompanying drawings.

FIGS. 1A to 1E are diagrams that mainly illustrate the ink filling procedures in an ink tank manufacturing method according to one embodiment of the present invention.

Figure 1A:
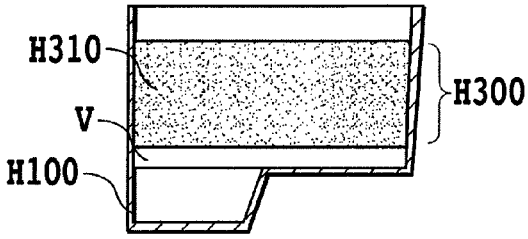
FIGS. 1A to 1E are diagrams particularly illustrating the ink filling procedures of the ink tank manufacturing processing, according to one embodiment of the present invention.

During the processing performed in this embodiment for the production of an ink tank that serves as a liquid storage container, first, as shown in FIG. 1A, an ink absorption member H300 is inserted into a tank case H100, and positioned so that an open space V is formed between the bottom of the tank case H100 and the lower portion of the ink absorption member H300. That is, the ink absorption member H300 for retaining liquid is inserted halfway in the tank case H100. At this time, it is preferable that the ink absorption member H300 is inserted in a compressed state, so that the elastic force produced by expansion of the ink absorption member H300 makes the ink absorption member closely contact with the inner walls (except for the bottom) of the tank case H100. In this case, the bottom of the liquid storage container corresponds to a lower side face of the container in a position that the liquid storage container is mounted on a liquid ejection apparatus, i.e., that the liquid storage container is mounted so that an ejection face of a liquid ejection head faces downward. In this embodiment the liquid ejection head for ejecting ink as a liquid, is a head of a type that generates bubbles by heating a liquid, and employs the energy produced by the generation of the bubbles to eject the liquid. Furthermore, a liquid ejection apparatus that employs the head of the embodiment is an inkjet printing apparatus that ejects ink droplets onto a printing medium, such as paper, to perform printing.

The tank case H100 is made of resin. A preferable material is a resin that contains 5% to 40% of a glass filler, added to provide increased rigidity. In addition, a compressed PP (polypropylene) fiber is employed for the ink absorption member H300.

Figure 1D:
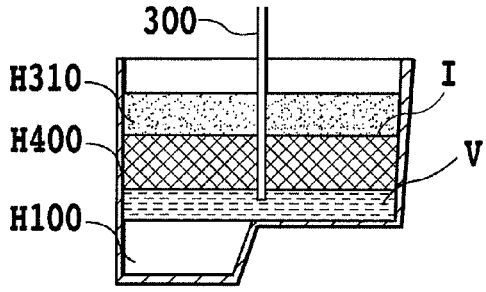
Figure 1B:
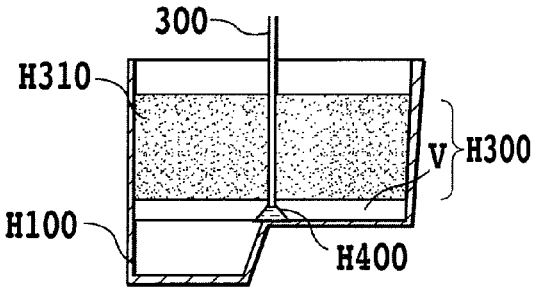

Next, as shown in FIG. 1B, as an ink injection member (a liquid injection member), an ink injection needle 300 is pushed through the ink absorption member H300, so that the tip of the ink injection needle 300 is located in the open space V in the tank case. Then, filling of ink H400 in which ink is made flow out from the tip of the ink injection needle, is begun. At this time, ink has not been permeated into the ink absorption member H300 (in Figures, an ink un-permeated portion of the ink absorption member H300 is denoted by a reference sign H310).

As a size of the ink injection needle 300, an injection needle of about 15 G is appropriate. It is, however, preferable that the size of the ink injection needle 300 is determined in accordance with the ink filling amount per unit time.

Figure 1E:
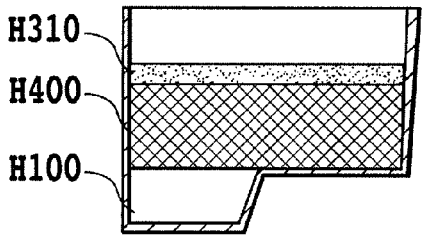
Figure 1C:
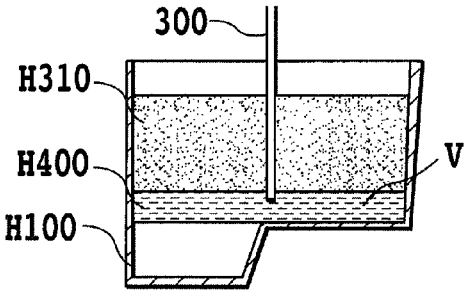

When the ink filling process is begun, most of the ink H400 supplied through the ink injection needle 300 initially spreads out through the space V formed in the tank case, rather than permeating the ink absorption member H300. Thereafter, as shown in FIG. 1C, the open space V has been filled with the ink H400 having an interface I parallel to the bottom of the ink tank. Since as described above, the space V is filled first with the ink and then the ink contacts with the ink absorption member, the contact can be made in a condition that the interface I of the filled ink which is parallel to the bottom of the ink tank is formed. Then, the ink permeation process can uninterruptedly be performed while the state of the parallel interface I is maintained. Thus, according to this specification, as the performance of the ink permeation process proceeds, an area constituting a boundary between the portion of the absorption member H300 that liquid has permeated and the portion that has not yet been permeated is consistently termed an "interface".

Furthermore, since the space V is the first area filled with ink, the ink injection speed, when compared with a case wherein ink is injected directly into an ink absorption member, is not greatly reduced. Thereby, ink injection can be performed within a comparatively short period of time, using only a single ink injection needle. In addition, since ink is supplied to fill the space V first, unlike a case wherein ink is injected directly into an absorption member, the ink injection speed need not be greatly reduced to establish a uniformly permeated state.

Then, as ink injection is continued from the state wherein the open space V has been filled, the ink H400 being fed into the open space V rises and permeates the ink absorption member H300, while maintaining the parallel interface I. And when the injection of ink H400 has been completed, an ink un-permeated layer H310, delimited by the parallel interface I, is formed as shown in FIG. 1D.

Thereafter, the ink absorption member H300 is pressed further down to the bottom of the tank case H100. As a result, as shown in FIG. 1F, the open space V disappears and the ink H400 that was present therein gradually permeates into the ink absorption member H300. During this permeation, the interface I continues to be maintained substantially parallel to the bottom of the ink tank.

It should be noted that the pressing down of the ink absorption member H300 is mechanically performed, using a pressing unit (not shown), only after the ink filling process has been completed. Alternately, the tank case cover H500, which is yet to be mounted, may be employed to press the ink absorption member H300 down, and may, thereafter, be mounted using welding.

Figure 8A:
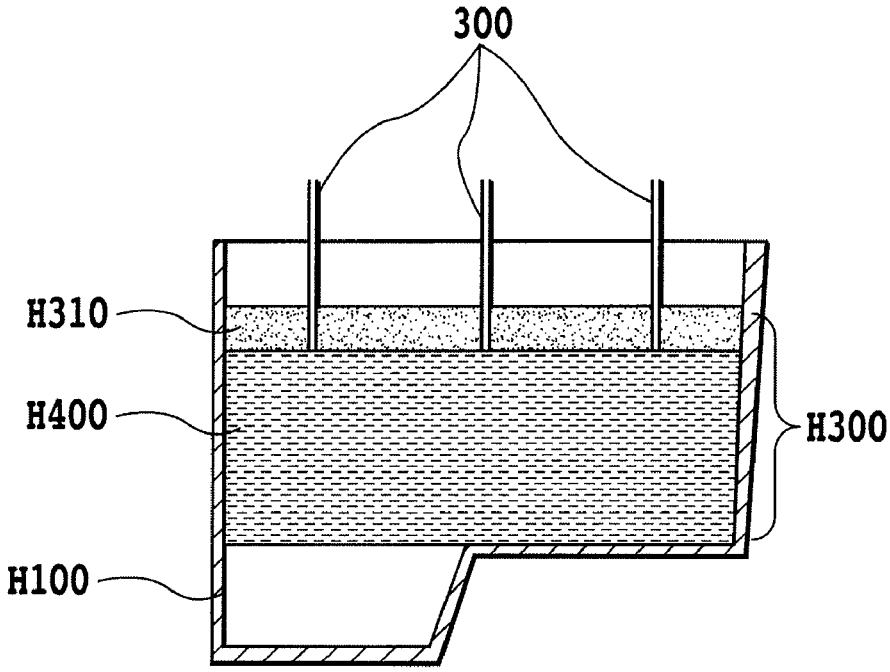
FIGS. 8A and 8B are diagrams for explaining the state of ink that has permeated an ink absorption member.
Figure 8B:
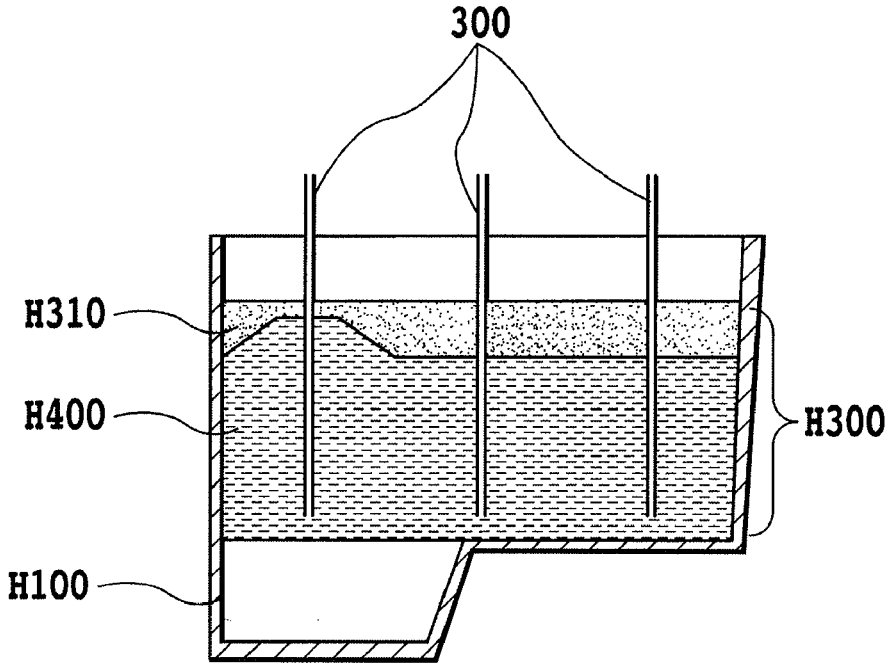

As one of the effects provided by the present invention when only a single injection needle is employed, as in the above embodiment, the time required for ink injection is not excessive. However, since the number of ink injection needles is not limited to one, a plurality of injection needles, such as the three shown in FIGS. 8A and 8B, can also be employed. In this case, conventional management to meter the volume of ink injected by the individual needles is not necessary, and accordingly, this device can be eliminated. As described above, according to the present invention, the uniform liquid permeated state can be established without increasing the size of the injection device and complicating the structure of the injection device, and of raising the production costs.

Further, according to the above described embodiment, since a liquid is injected into an open space defined beneath the absorption member, the absorption member serves as a lid, and can prevent the liquid from spilling out of the liquid storage portion while being transported along a manufacturing line, or by being partially expelled by shock as the absorption member is pressed further in.

Figure 2A:
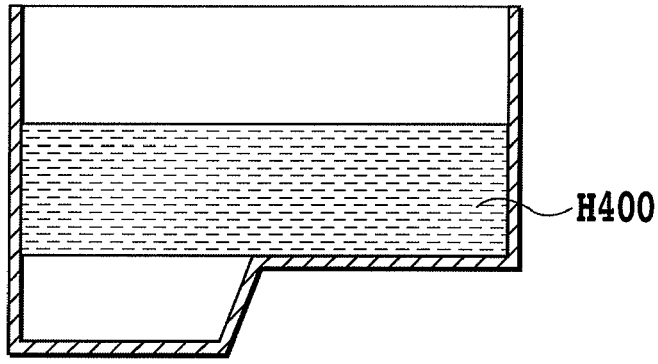
FIGS. 2A to 2C are diagrams particularly illustrating the ink filling procedures of the ink tank manufacturing processing, according to another embodiment of the present invention.
Figure 2B:
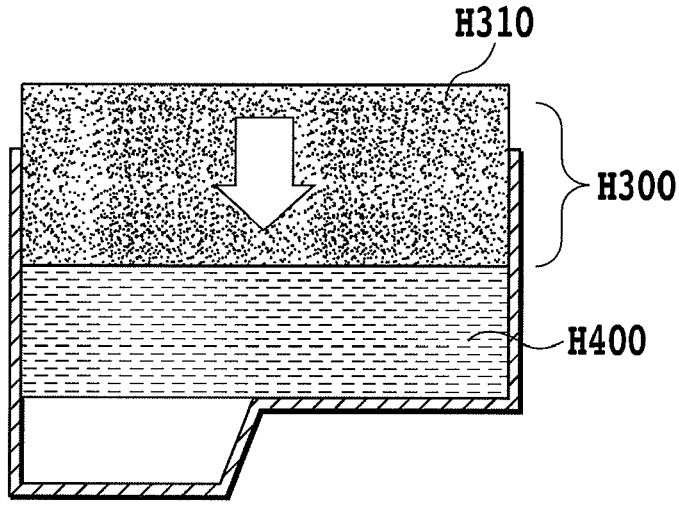
Figure 2C:
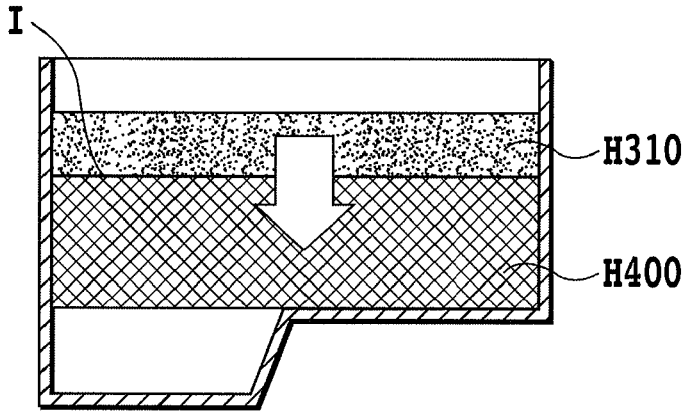

FIGS. 2A to 2C are diagrams for explaining the ink filling procedures according to another embodiment of the present invention. As shown in FIGS. 2A to 2C, this embodiment relates to an arrangement employed to perform an ink filling process for which an ink injection needle or ink injection needles are not required. Specifically, in this embodiment, first, a liquid, such as ink (H400), is introduced into the liquid storage portion of a liquid storage container (a tank case) (FIG. 2A). Sequentially, thereafter, an absorption member (H300) is located to be opposed to a liquid surface of the liquid in the liquid storage portion and inserted into the liquid storage portion. Thereby, the lower portion of the absorption member contacts with the surface of the liquid in the storage container (FIG. 2B). Then, the absorption member H300 is pressed down further until settled against a bottom of the liquid storage container (FIG. 2C).

As described above, since the areas of contact between the liquid in the storage container and the absorption member are comparatively large, the total period of time required for the liquid to permeate the absorption member is shorter than when an ink injection needle or ink injection needles are employed. In addition, since the absorption member is brought into contact with the liquid, the liquid surfaces moves up in a condition that the interface I is parallel to the bottom of the tank case.

Further, when the bottom of the absorption member that contacts the liquid surface is plane, the above described effects of the present invention can be more increased.

The ink tank provided through the above described ink filling process realizes a ink filled condition for sparing to prevent the occurrence of ink leakage.

Several specific examples of ink filling in the above described ink tank manufacturing methods will be described below.

EXAMPLE 1

Figure 3:
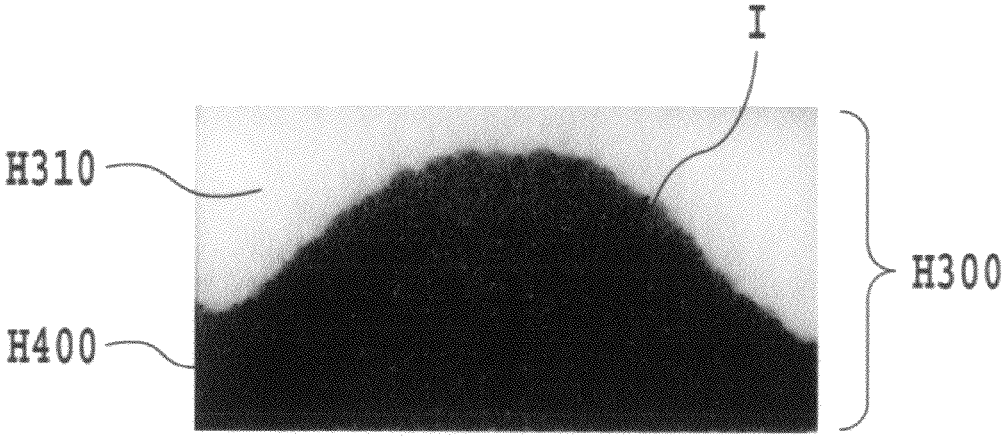
FIG. 3 is a diagram illustrating the state of ink used to permeate an ink absorption member.

To confirm that the ink H400 has properly permeated the ink absorption member H300, the ink filling method of the present invention is performed and the ink absorption member H300 is then extracted from the tank case H100. And as shown in FIG. 3, the state of the ink un-permeated layer H310 is visually examined.

In example 1, first, the ink absorption member H300 and the tank case H100 are prepared. The characteristics of the ink absorption member H300 are that this component is composed of an absorptive PP (polypropylene) fiber, and that the density of the ink absorption member H300 is about 0.09 g/cm$^3$.

Sequentially, as shown in FIG. 1A, the ink absorption member H300 is inserted into the tank case H100 so that the open space V is defined between the bottom of the tank case H100 and the ink absorption member H300.

Figure 4:
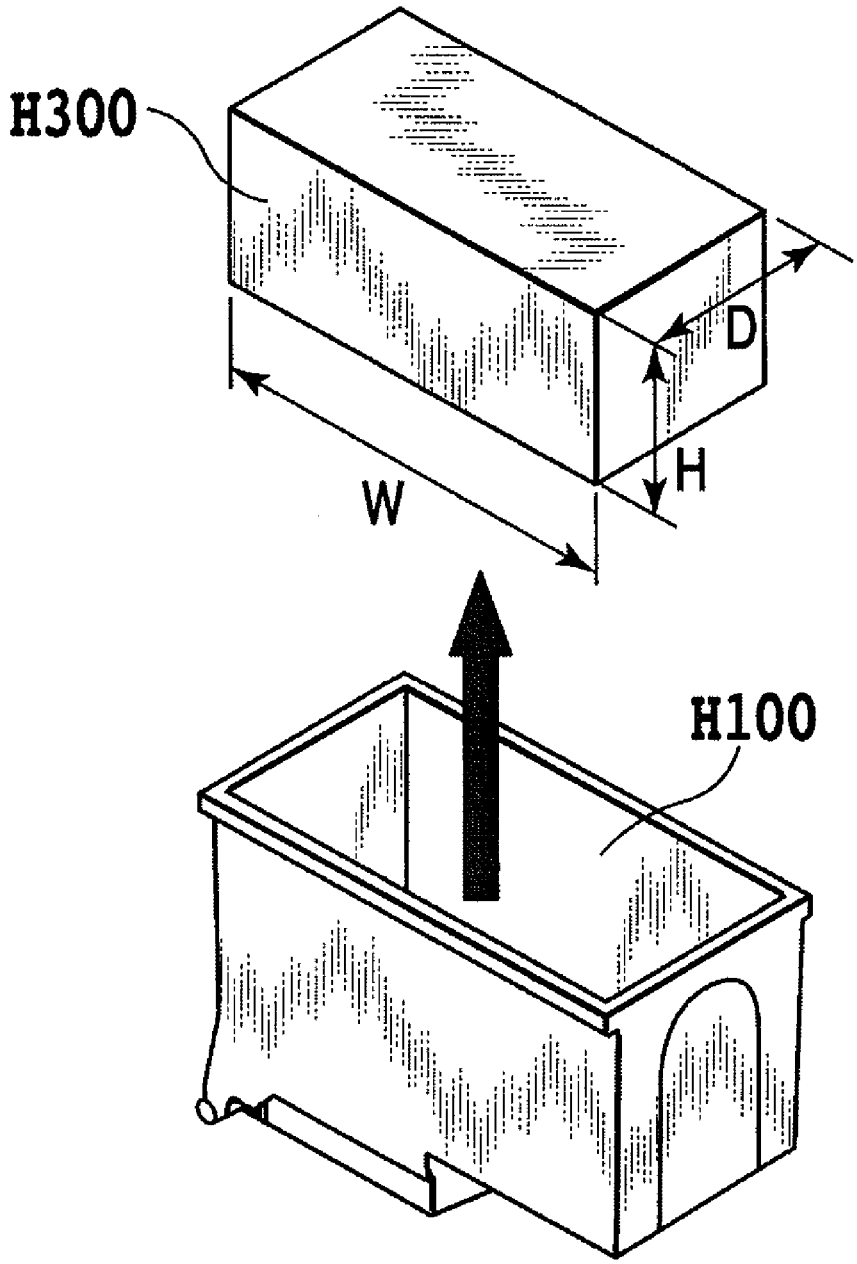
FIG. 4 is a perspective view illustrating the size of an ink absorption member according to one example of the present invention.

It should be noted that, as shown in FIG. 4, the ink absorption member H300 inserted into the tank case H100 has a width W of 51 mm, a depth D of 25.5 mm and a height H of 27.3 mm, and that the ratio of the open space V in the tank case H100 is defined as 8% of the volume of the ink absorption member H300 occupying the inside of the tank case.

Following this, as shown in FIG. 1B, the ink injection needle 300 is pushed through the ink absorption member H300 until the tip of the ink injection needle 300 is positioned inside the space V. In this state, wherein the tank case H100 is horizontally positioned and maintained, ink injection is started by supplying ink H400 through the ink injection needle tip at an injection speed of 12 g/second. As the characteristics of the ink H400, the viscosity is about 2.0 m·Pa·s, and the surface tension is about 40 mN/m.

When the ink injection is initiated, most of the ink H400 supplied through the ink injection needle 300 spreads out through the open space V, defined between the ink absorption member H300 and the tank case H100, rather than permeating the ink absorption member H300.

When ink injection is continued, as shown in FIG. 1C, the open space V is filled with ink H400, the upper surface of which then constitutes the horizontal interface. And then, when ink injection is continued, the ink H400 in the open space V gradually permeates the ink absorption member H300, while the interface is maintained parallel to the bottom of the tank case. Finally, when the injection of ink is completed, the formation of the ink un-permeated layer H310, which is parallel to the bottom of the tank, as shown in FIG. 1D, is also completed.

Thereafter, the ink absorption member H300 is pressed down until settled against the bottom of the tank case H100. Thus, as shown in FIG. 1E, the space V has disappeared, and the ink H400 present in the space V is gradually permeating the ink absorption member H300.

Figure 5:
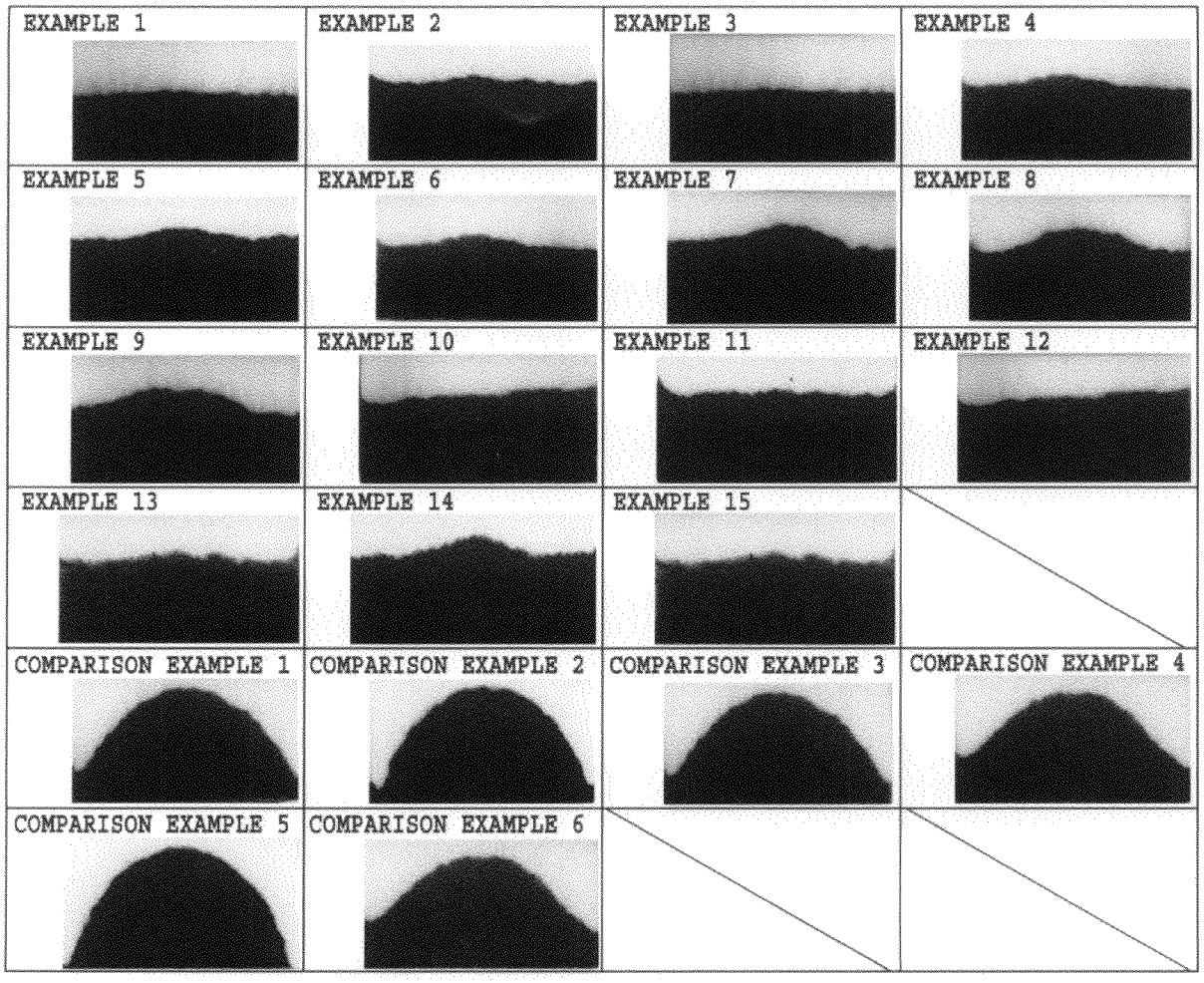
FIG. 5 is a diagram illustrating the states of ink that has permeated an ink absorption member for examples that are concrete instances of the present invention, and comparison examples.
Figure 7A:
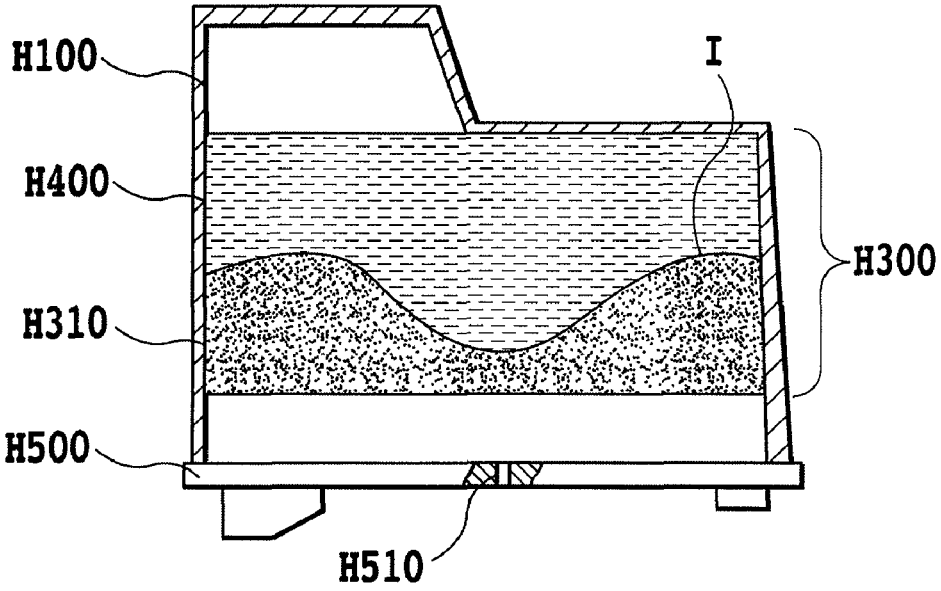
FIGS. 7A to 7D are diagrams for explaining an ink leak in an ink tank.
Figure 7B:
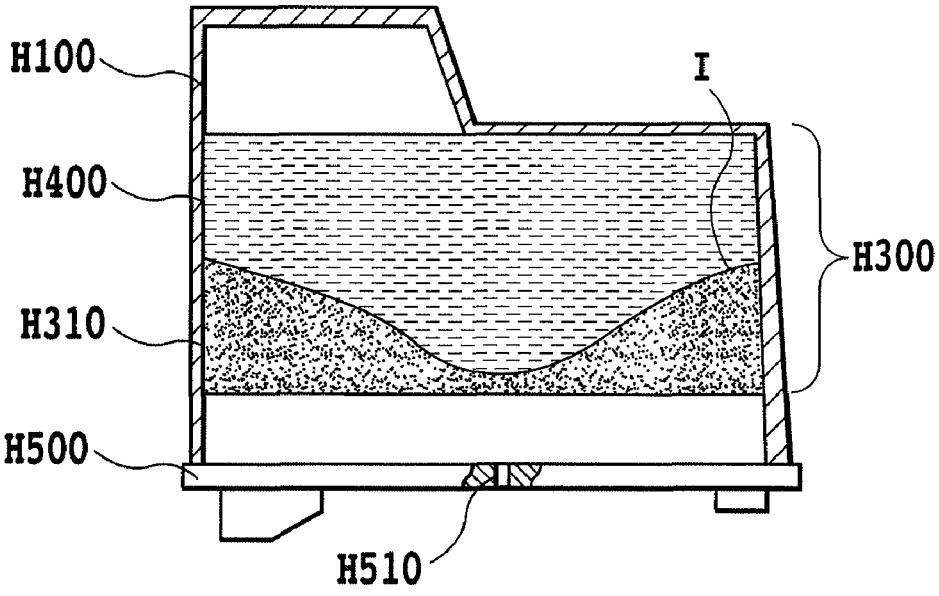
Figure 7C:
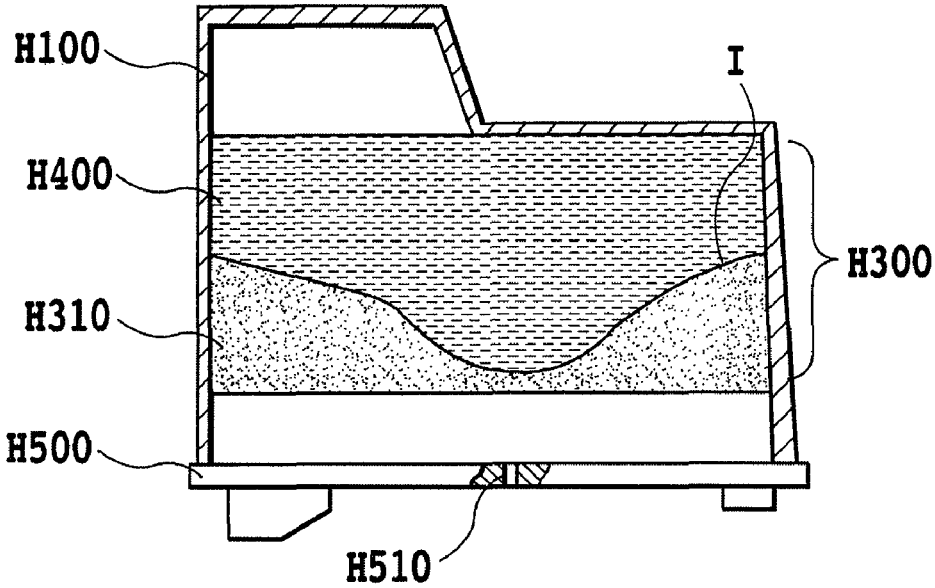
Figure 7D:
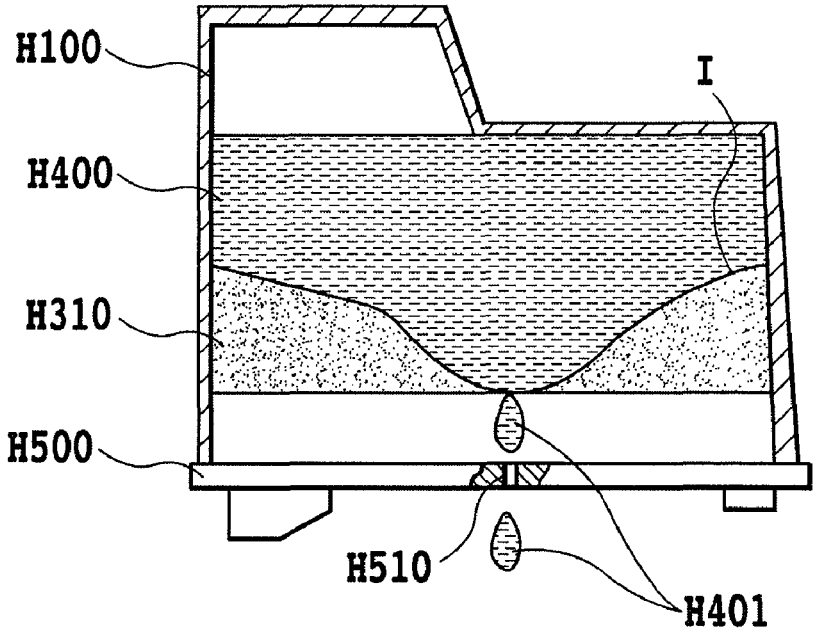

The actual state in example 1, wherein the ink H400 permeated the ink absorption member H300, is shown as "Example 1" in FIG. 5.

As described above, in the ink filling method of example 1, since the equivalent of 8% of the volume of the ink absorption member is used for the open space V, an ink permeated state is established wherein the horizontal and comparatively thick, ink un-permeated layer H310 is provided. In addition, the ink injection speed of 12 g/second is available using a single ink injection needle.

EXAMPLE 2 TO EXAMPLE 15

Example 2 to Example 15, for the ink filling processing, will now be described.

Level "C" indicates a state wherein an ink un-permeated layer H310 having a raised shape is obtained after an ink H400 permeation process for the ink absorption member is completed.

The actual states of the ink H400 permeated in the ink absorption member H300 in examples 2 to 15 are shown in FIG. 5.

TABLE 1

| | Long side length W (mm) | Short side length D (mm) | Height H (mm) | Volume ($mm^3$) | ink to be injected (g) | Injection speed (g/sec) | Space V (%) | Results |
|---|---|---|---|---|---|---|---|---|
| Example 1 | 51 | 25.5 | 27.3 | 35503.7 | 24 | 12 | 8 | A |
| Example 2 | 51 | 12.8 | 27.3 | 17821.4 | 12 | 12 | 8 | A |
| Example 3 | 51 | 6.6 | 27.3 | 9189.2 | 6 | 12 | 8 | A |
| Example 4 | 51 | 25.5 | 27.3 | 35503.7 | 24 | 12 | 4 | A |
| Example 5 | 51 | 12.8 | 27.3 | 17821.4 | 12 | 12 | 4 | A |
| Example 6 | 51 | 6.6 | 27.3 | 9189.2 | 6 | 12 | 4 | A |
| Example 7 | 51 | 25.5 | 27.3 | 35503.7 | 24 | 12 | 2 | B |
| Example 8 | 51 | 12.8 | 27.3 | 17821.4 | 12 | 12 | 2 | B |
| Example 9 | 51 | 6.6 | 27.3 | 9189.2 | 6 | 12 | 2 | B |
| Example 10 | 51 | 25.5 | 27.3 | 35503.7 | 24 | 24 | 8 | A |
| Example 11 | 51 | 12.8 | 27.3 | 17821.4 | 12 | 24 | 8 | A |
| Example 12 | 51 | 6.6 | 27.3 | 9189.2 | 6 | 24 | 8 | A |
| Example 13 | 51 | 25.5 | 27.3 | 35503.7 | 24 | 24 | 4 | A |
| Example 14 | 51 | 12.8 | 27.3 | 17821.4 | 12 | 24 | 4 | A |
| Example 15 | 51 | 6.6 | 27.3 | 9189.2 | 6 | 24 | 4 | A |
| Comparison example 1 | 51 | 25.5 | 27.3 | 35503.7 | 24 | 12 | 0 | C |
| Comparison example 2 | 51 | 12.8 | 27.3 | 17821.4 | 12 | 12 | 0 | C |
| Comparison example 3 | 51 | 6.6 | 27.3 | 9189.2 | 6 | 12 | 0 | C |
| Comparison example 4 | 51 | 25.5 | 27.3 | 35503.7 | 24 | 24 | 0 | C |
| Comparison example 5 | 51 | 12.8 | 27.3 | 17821.4 | 12 | 24 | 0 | C |
| Comparison example 6 | 51 | 6.6 | 27.3 | 9189.2 | 6 | 24 | 0 | C |

Table 1 shows the operational conditions and the results respectively obtained for examples 1 to 15 and comparison examples 1 to 6.

As operational conditions for the individual examples, three short side lengths D, 25.5 mm, 12.8 mm and 6.6 mm, were prepared and employed for ink absorption members H300 having different shapes, as well as two ink injection speeds of 12 g/second and 24 g/second that were selectively employed. The viscosity of the ink H400 is defined as about 2.0 m·Pa·s, and the surface tension is regarded as about 40 mN/m. The volume ratio of the space V to the ink absorption member is regarded as one of threes 8%, 4% or 2%, while for comparison examples, the volume ratio for the space V was set to 0%. The results obtain by the experiments are indicated by "A", "B" and "C", in accordance with the level of uniformity in the ink permeated state, as will be described below. It should be noted that the size of each absorption member here indicates the size when it is stored in the tank case.

Level "A" indicates a state wherein a parallel, thick, ink un-permeated layer H310 is obtained after an ink H400 permeation process performed for the ink absorption member H300 is completed.

Level "B" indicates a state wherein, although slightly raised in the center, a nearly parallel, thick, ink un-permeated layer H310 is obtained after an ink H400 permeation process performed for the ink absorption member H300 is completed.

Based on the results described for these examples and comparison examples, the following effects can be obtained.

When the ink injection speed is 12 g/second, in the ink permeated states for comparison examples 1 to 3, for which the volume ratio of the open space V is set to 0%, the ink un-permeated layer H310 had a raised shape.

When the ratio for the open space V is set to 2%, however, the ink permeated state providing the raised ink un-permeated layer H310 is changed to an ink permeated state providing a nearly horizontal, thick, ink un-permeated layer H310.

When the ratio for the space V is set to 4% or more, an ink permeated state providing a horizontal, thick, ink un-permeated layer H310 is established.

At the ink injection speed of 24 g/second, in the ink permeated states for comparison examples 4 to 6, with the ratio for open space V set to 0%, the ink un-permeated layer H310 has a raised shape.

However, when the volume of the open space V is set to 4% or more, the ink permeated state is changed to a state providing a horizontal, thick, ink un-permeated layer H310.

As described above, according to the ink filling method of the present invention, when the volume of the open space V is set to 4% or more, an ink injection speed of 24 g/second can be obtained using only a single ink injection needle. While according to the conventional method for which a plurality of ink injection needles are employed, three or more ink injection needles are required to provide an ink injection speed of 24 g/second, and the device structure becomes complicated.

Thus, when the present invention is applied the number of ink injection needles required can be reduced from three to one, and accordingly, since this will lower production costs and a simpler structure will be required, an ink tank can be provided that can maintain a uniform ink permeated state and effectively prevent ink leakage.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-186115, filed Jul. 17, 2008, which is hereby incorporated by reference herein in its entirety.

What is claimed is:

1. A method of manufacturing a liquid storage container that includes a liquid storage portion and an absorption member for retaining liquid and is mounted on a liquid ejection apparatus, said method comprising the steps of:

inserting the absorption member halfway into the liquid storage portion so that a space is formed between a bottom surface of the liquid storage portion and a bottom surface of the absorption member;

penetrating the absorption member with a liquid injection member injecting liquid into the space through the liquid injection member; and inserting the absorption member into the liquid storage portion so that the absorption member is in contact with a bottom surface of the liquid storage portion.

2. A method as claimed in claim 1, wherein the liquid is injected into the space after the surface of the liquid in the liquid storage portion and the absorption member are made to contact with each other.

3. A method as claimed in claim 1, wherein a ratio of the space is defined as 4% or more of a volume of the absorption member which has been inserted in the liquid storage portion.

4. A method as claimed in claim 1, wherein a portion of the absorption member which contacts with the liquid has planar surface.

5. A method as claimed in claim 1, wherein the injection member is an injection needle.

* * * * *